United States Patent [19]

O'Handley

[11] Patent Number: 4,755,239

[45] Date of Patent: Jul. 5, 1988

[54] LOW MAGNETOSTRICTION AMORPHOUS METAL ALLOYS

[75] Inventor: Robert C. O'Handley, Bedford Hills, N.Y.

[73] Assignee: Allied-Signal Inc., Morris Township, Morris County, N.J.

[21] Appl. No.: 881,566

[22] Filed: Jul. 2, 1986

Related U.S. Application Data

[63] Continuation of Ser. No. 483,454, Apr. 8, 1983, abandoned.

[51] Int. Cl.[4] ..... C22C 19/03; C22C 19/07

[52] U.S. Cl. ..... 148/304; 148/403

[58] Field of Search ..... 148/403, 304, 305

[56] References Cited

U.S. PATENT DOCUMENTS 4,056,411 11/1977 Chen et al. ..... 148/403

4,225,339 9/1980 Inomata et al. ..... 148/403

*Primary Examiner*—R. Dean

*Attorney, Agent, or Firm*—Gus T. Hampilos; Ernest D. Bluff

[57] ABSTRACT

Cobalt rich amorphous metal alloys have a value of magnetostriction of about $-6\times10^{-6}$ to $+4\times10^{-6}$ and a saturation induction of about 0.1 to 1.0T. The alloys, especially suited for soft magnetic applications, have the formula $(Co_{1-x}T_x)_{100-b}(B_{1-y}Y_y)_b$, where T is at least one of Cr and V, Y is at least one of carbon and silicon, B is boron, x ranges from about 0.05 to 0.25, y ranges from about 0 to 0.75 and b ranges from about 14 to 28.

3 Claims, 5 Drawing Sheets

$(Co_{1-x-y}Fe_xT_y)_{80}B_{20}$

LOW MAGNETOSTRICTION AMORPHOUS METAL ALLOYS

This application is a continuation of application Ser. No. 483,454 filed Apr. 8, 1983 abandoned.

BACKGROUND OF THE INVENTION

1. Field of the Invention

This invention relates to amorphous metal alloys and, more particularly, to cobalt rich amorphous metal alloys that include certain transition metal and metalloid elements.

2. Description of the Prior Art

There are three physical parameters which can inhibit the easy magnetization and demagnetization of magnetic materials: strong anisotropy, non-zero magnetostriction and, at high frequencies, low resistivity. Metallic glasses generally show resistivities greater than 100 micro ohm cm, whereas crystalline and polycrystalline magnetic metals generally show resistivities below 50 micro ohm cm. Also, because of their randomly disordered structures, metallic glasses are typically isotropic in their physical properties, including their magnetization. Because of these two characteristics, metallic glasses have an initial advantage over conventional magnetic metals. However, metallic glasses do not generally show zero magnetostriction. When zero magnetostriction glasses can be found they are generally good soft magnetic metals (R. C. O'Handley, B. A. Nesbitt, and L. I. Mendelsohn, IEEE Trans Mag-12, p. 942, 1976, U.S. Pat. Nos. 4,038,073 and 4,150,981), because they satisfy the three approved criteria For this reason, interest in zero magnetostriction glasses has been intense as indicated by the many publications on low magnetostriction metallic glasses (A. W. Simpson and W. G. Clements, IEEE Trans Mag-11, p. 1338, 1975; N. Tsuya, K. I. Arai, Y. Shiraga and T. Masumoto, Phys. Lett. A51, p. 121, 1975; H. A. Brooks, Jour. Appl. Phys. 47, p. 334, 1975; T. Egami, P. J. Flanders and C. D. Graham, Jr., Appl. Phys. Lett. 26, p. 128, 1975 and AIP Conf. Proc. No. 24, p. 697, 1975; R. C. Sherwood, E. M. Gyorgy, H. S. Chen, S. D. Ferris, G. Norman and H.J. Leamy, AIP Conf. Proc. No. 24, p. 745, 1975; H. Fujimori, K. I. Arai, H. Shiraga, M. Yamada, T. Masumoto and N. Tsuya, Japan, Jour. Appl. Phys. 15, p. 705, 1976; L. Kraus and J. Schneider, phys. stat. sol. a39, p. K161, 1977; R. C. O'Handley in Amorphous Magnetism, edited by R. Levy and R. Hasegawa (Plenum Press, New York 1977), p. 379; R. C. O'Handley, Solid State Communications 21, p. 1119, 1977; R. C O'Handley, Solid State Communications 22, p. 458, 977; R. C. O'Handley, Phys. Rev. 18, p. 930, 1978; H. S. Chen, E. M. Gyorgy, H. J. Leamy and R. C. Sherwood, U.S. Pat. No. 4,056,411, Nov. 1, 1977).

The existence of a zero in the magnetostriction of Co-Mn-B glasses has been observed by H. Hiltzinger of Vacuumschmeltze A.G., Hanau, Germany.

Reference to Co-rich glasses containing 6 atom percent of Cr is made by N. Heiman, R. D. Hempstead and N. Kazama in Journal of Applied Physics, Vol. 49, p. 663, 1978. Their interest was in improving the corrosion resistance of Co-B thin films. No reference to magnetostriction is made in that article.

Saturation moments and Curie temperatures of $Co_{80-x}T_xP_{10}B_{10}$ glasses (T=Mn, Cr, or V) were recently reported by T. Mizoguchi in the Supplement to the Scientific Reports of RITU (Research Institutes of Tonoku University), A June 1978, p. 117. No reference to their magnetostrictive properties was reported.

In Journal of Applied Physics, Vol. 50, p. 7597, 1979, S. Ohnuma and T. Masumoto outline their studies of magnetization and magnetostriction in Co-Fe-B-Si glasses with light transition metal (Mn, Cr, V, W, Ta, Mo and Nb) substitutions. They show that the coercivity decreases and the effective permeability increases in the composition range near zero magnetostriction.

New applications requiring improved soft zero-magnetic materials that are easily fabricated and have excellent stability have necessitated efforts to develop further specific compositions.

SUMMARY OF THE INVENTION

The present invention provides low magnetostriction and zero magnetostriction glassy alloys that are easy to fabricate and thermally stable. The alloys are at least about 50 percent glassy and consist essentially of compositions defined by the formula: $(Co_{1-x}T_x)_{100-b}(B_{1-y}Y_y)_B$, where T is at least one of Cr and V, Y is at least one of carbon and silicon, B is boron, x ranges from about 0.05 to 0.25, y ranges from about 0 to 0.75, and b ranges from about 14 to 28 atom percent. The alloys of the invention have a value of magnetostriction ranging from about $-6\times10^{-6}$ to $4\times10^{-6}$ and a saturation induction of about 0.2 to 1.0 T.

In addition, the invention provides cobalt-iron-nickel base and nickel-rich magnetic alloys that are easily fabricated and thermally stable. The cobalt-iron-nickel base alloys are at least 50 percent glassy and consist essentially of compositions defined by the formula: $(Co_{1-x-y-z}Fe_xNi_yT_z)_{100-b}(B_{1-w}M_w)_b$, where T is at least one of Mn, V, Ti, Mo, Nb and W, M is at least one of Si, P, C and Ge, B is boron, x ranges from about 0.05 to 0.25, y ranges from about 0.05 to 0.80, z ranges from about 0 to 0.25, b ranges from about 12 to 30 atom percent, w ranges up to 0.75 when M is Si or Ge and up to 0.5 when M is C or P. These alloys have a value of magnetostriction of about $-7\times10^{-6}$ and $+5\times10^{-6}$ and a saturation induction of about 0.2 to 1.4 T. The nickel-rich alloys are at least 50 percent glassy and consist essentially of compositions defined by the formula: $(Ni_{0.5}Co_{0.5-x}T_x)_{100-b}B_b$, where T is at least one of Mn, Cr and V, B is at least one of B, Si, P, C and Ge, x is less than 0.25, and b ranges from 17 to 22 atom percent. The nickel-rich alloys have a value of magnetostriction of about $-8\times10^{-6}$ to $+2\times10^{-6}$ and a saturation induction of about 0.3 to 0.8 T.

BRIEF DESCRIPTION OF THE DRAWINGS

The invention will be more fully understood and further advantages will become apparent when reference is made to the following detailed description of the preferred embodiments of the invention and the accompanying drawings, in which.

DESCRIPTION OF THE PREFERRED EMBODIMENTS

Figure 1:
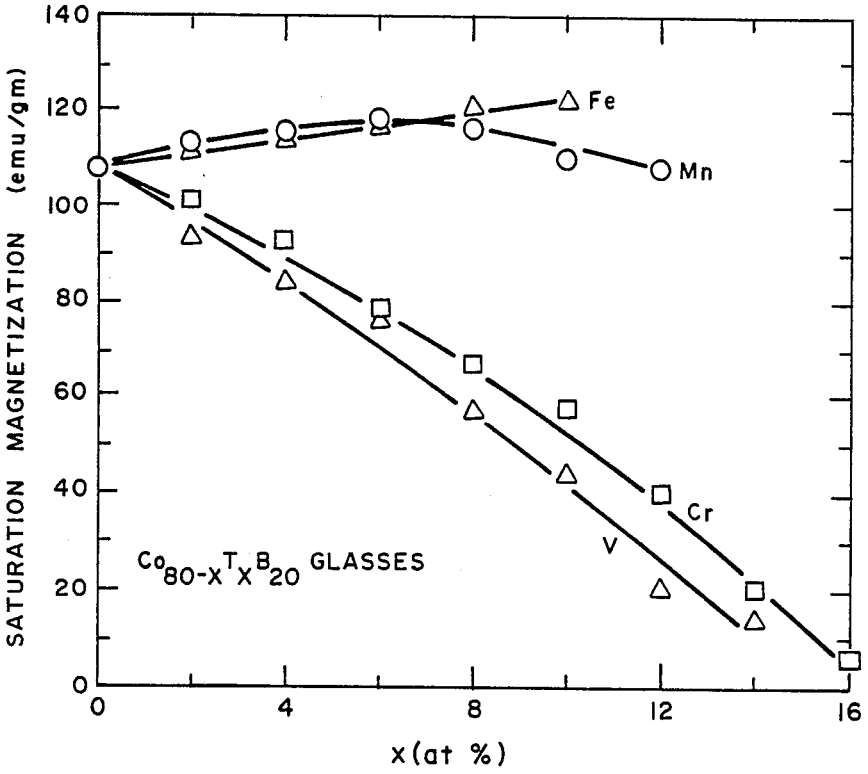
FIG. 1 is a graph showing saturation magnetization for compositions defined by the formula $Co_{80-x}T_xB_{20}$, where T is at least one of Fe, Mn, Cr and V and x ranges up to about 16 atom percent.

In accordance with the invention, there is provided a magnetic alloy that is at least 50 percent glassy and consists essentially of the composition: $(Co_{1-x}T_x)_{100-b}(B_{1-y}Y_y)_b$, where T is at least one of chromium and vanadium, Y is at least one of carbon and silicon, x ranges from about 0.05 to 0.25, y ranges from about 0 to 0.75, and b ranges from about 14 to 28 atom percent. The glassy alloy has a value of magnetostriction of about $-6\times10^{-6}$ to $4\times10^{-6}$ and a saturation induction of about 0.2 to 1.0 T.

The purity of the above composition is that found in normal commercial practice. However, it will be appreciated that the alloys of the invention may contain, based on total composition, up to about 5 atom percent of at least one other transition metal element, such as Fe, Co, Ni, Cu, Zn, Mn, Cr, V, Ti, Zr, Nb, Ta, Mo, W, Ru, Rh and Pd, and up to about 2 atom percent based on total composition of at least one other metalloid element, such as B, C, Si, P, Ge, Al, N, O and S, without significantly degrading the desirable magnetic properties of these glassy alloys.

The amorphous alloys of the invention can be formed by cooling a melt of the composition at a rate of at least about $10^5$° C./sec. A variety of techniques are available, as is now well-known in the art, for fabricating splat-quenched foils and rapid-quenched continuous ribbons, wire, sheet, etc. Typically, a particular composition is selected, powders of the requisite elements (or of materials that decompose to form the elements, such as nickel-borides, etc.) in the desired proportions are melted and homogenized, and the molten alloy is rapidly quenched either on a chill surface, such as a rotating cooled cylinder, or in a suitable fluid medium, such as a chilled brine solution. The amorphous alloys may be formed in air. However, superior mechanical properties are achieved by forming these amorphous alloys in a partial vacuum with absolute pressure less than about 5.5 cm of Hg, and preferably about 100 μm to 1 cm of Hg, as disclosed in U.S. Patent No. 4,154,283 to Ray et al.

The amorphous metal alloys are at least 50 percent amorphous, and preferably at least 80 percent amorphous, as measured by X-ray diffraction. However, a substantial degree of amorphousness approaching 100 percent amorphous is obtained by forming these amorphous metal alloys in a partial vacuum. Ductility is thereby improved, and such alloys possessing a substantial degree of amorphousness are accordingly preferred.

Ribbons of these alloys find use in soft magnetic applications and in applications requiring low magnetostriction, high thermal stability (e.g., stable up to about 100° C.) and excellent fabricability.

The following example is presented to provide a more complete understanding of the invention. The specific techniques, conditions, materials, proportions and reported data set forth to illustrate the principles and practice of the invention are exemplary and should not be construed as limiting the scope of the invention.

EXAMPLE

An alloy melt of known composition was rapidly quenched to form non-crystalline ribbons, presumably of the same composition as the melt. The ribbons, typically 40 micrometers (μm) by 2 mm in cross section, were cut into squares for vibration-sample magnetometer measurements of specific magnetization $\sigma$(4.2K, 9 KOe) and $\sigma$(T, 9 KOe) with 295 K<T<$T_x$, the crystallization temperature. Curie temperatures were obtained from the inflection points in the $\sigma$(T, 9 KOe) curves.

The magnetostriction measurements were made in fields up to 4 KOe with metal foil strain gauges (as reported in more detail by R. C. O'Handley in Solid State Communications, Vol. 22, p. 485, 1977). The accuracy of these measurements is considered to be within 10 percent of full strain and their strain sensitivity is on the order of $10^{-7}$.

Composition variations of the room temperature specific saturation magentizations $\sigma$(295 K, 9 KOe) as functions of composition x for $Co_{80-x}T_xB_{20}$ (T=Fe, Mn, Cr, V) glasses are shown in FIG. 1. The trends in FIG. 1 reflect the variations of both the saturation moments n and the Curie temperatures TC of these alloys.

Figure 2:
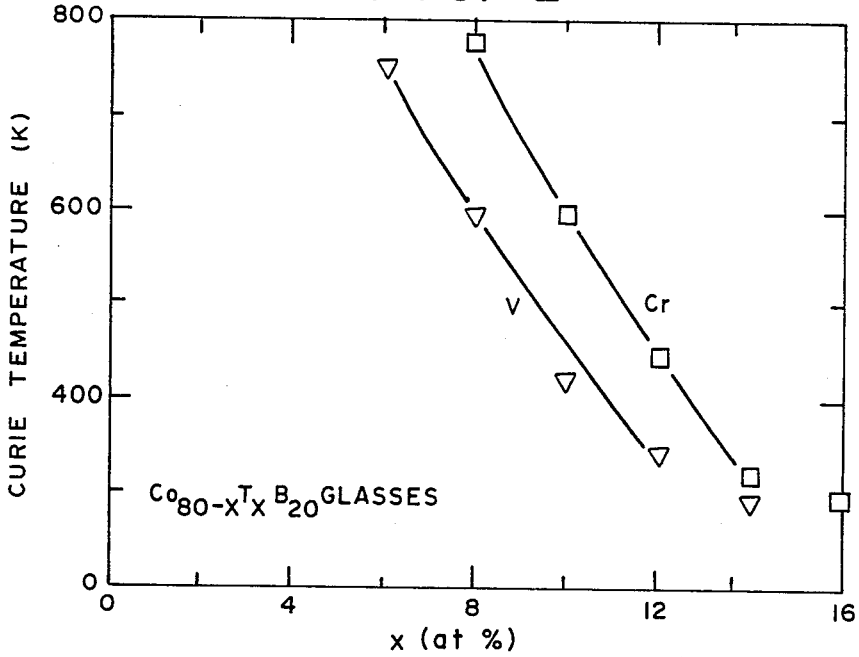
FIG. 2 is a graph showing Curie temperatures of compositions for which $T_c$ is below the crystallization temperature $T_x$.

The Curie temperatures of Co-rich glasses are generally well above the temperatures for crystallization $T_x$ but fall below $T_x$ for sufficiently large additions of Cr or V (FIG. 2).

In order to be useful in magnetic devices, materials should show appreciable magnetization. Commercial zero magnetostriction crystalline metallic alloys of the class exemplified by Permalloy $(Ni_{82}Fe_{18})_{1-x}X_x$ with x=Mo or Cu and x<0.04) have saturation inductions $B_s=H+4\pi Ms=4\pi M_s$ of about 0.6 to 0.8 tesla (6 to b 8 kGauss). The specific magnetizations in FIG. 1 can be converted to tesla by multiplying by the mass density times $4\pi/10{,}000$. Densities for the glasses studied here can be estimated from the measured densities for $Co_{80}B_{20}$, $Fe_{80}B_{20}$ and $Co_{70}Fe_{10}B_{20}$ Co glasses and the known densities of crystalline Co, Fe, Mn, Cr and V.

Defining $\rho_x$ to be the mass density of the crystalline material X and $\rho_g$ to be that of the glassy material $X_{80}B_{20}$, the ratios of the measured quantities $\rho_g/\rho_x$ were found to be 0.92 and 0.94 for $Co_{80}B_{20}$ and $Fe_{80}B_{20}$ glasses. A similar trend holds for the hypothetic thetical $X_{80}B_{20}$ glasses listed in Table I. The estimated densities of $X_{80}B_{20}$ (X=Mn, Cr, V) glasses are also set forth in Table I. The densities of $CO_{70}X_{10}B_{20}$ glasses were calculated by linearly combining the densities of $Co_{80}B_{20}$ and $X_{80}B_{20}$. The value so obtained for $Co_{70}Fe_{10}B_{20}$ and than 1 percent larger than the measured density for that glass.

TABLE I

Densities and Saturation Inductions for $Co_{70}X_{10}B_{20}$ Glasses

| | Crystalline X | $X_{80}B_{20}$ Glass | | $Co_{70}X_{10}B_{20}$ Glass | |
|---|---|---|---|---|---|
| X | $\rho_x$ Density (gm/cm³) | $\rho_g$ Density (gm/cm³) | $\rho_g/\rho_x$ | Density (gm/cm³) | Saturation Induction (tesla) |
| Co | 8.90 | 8.22 (a) | .92 | 8.22 (a) | 1.14 (a) |

TABLE I-continued

| Densities and Saturation Inductions for $Co_{70}X_{10}B_{20}$ Glasses | | | | | |
|---|---|---|---|---|---|
| | Crystalline X | $X_{80}B_{20}$ Glass | | $Co_{70}X_{10}B_{20}$ Glass | |
| X | $\rho_x$ Density (gm/cm$^3$) | $\rho_g$ Density (gm/cm$^3$) | $\rho_g/\rho_x$ | Density (gm/cm$^3$) | Saturation Induction (tesla) |
| Fe | 7.86 | 7.41 (a) | .94 | 8.12 (b) | 1.25 (c) |
| | | | | 8.06 (a) | 1.24 (a) |
| Mn | 7.43 | 7.06 (b) | .95 | 8.06 (b) | 1.11 (c) |
| Cr | 7.19 | 6.90 (b) | .96 | 8.04 (b) | 0.59 (c) |
| V | 6.00 | 5.82 (b) | .97 | 7.92 (b) | 0.43 (c) |

(a) measured
(b) estimated
(c) measured specific magnetization, estimated density.

Figure 3:
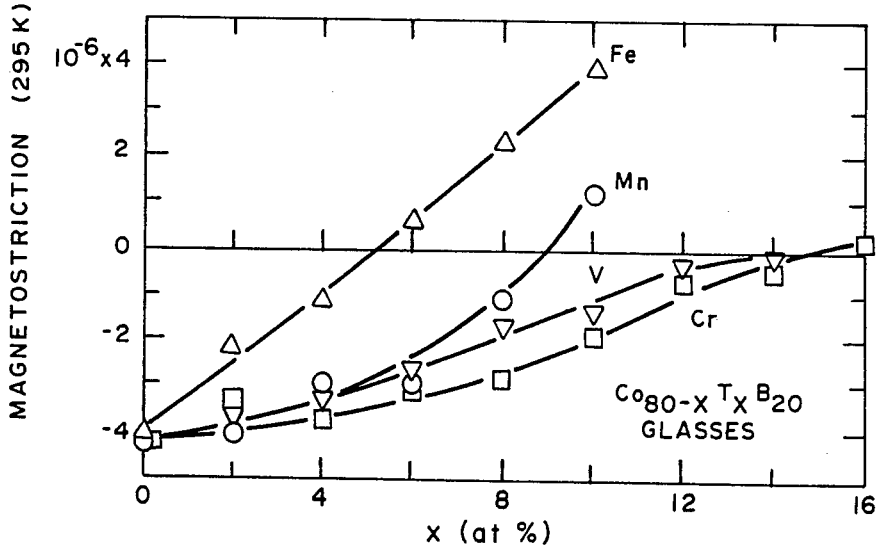
FIG. 3 is a graph showing the relationships between saturation magnetostriction and composition for selected alloys of the invention.

In FIG. 3, there is shown the effects of Fe, Mn, Cr and V substitutions on the saturation magnetostriction of $Co_{80}B_{20}$ glass. As is the case with the Fe substitutions for Co disclosed by U.S. Pat. No. 4,038,073 to O'Handley et al., the lighter transition metals cause $\lambda_5$ to increase through zero, positive below $T_c$ for Mn and Cr substitutions and go to zero for V substitutions. In the case of $Co_{66}V_{14}B_{20}$ glass, $T_c$=300 K (FIG. 2). Thus, the room temperature magnetostriction is zero probably because of the low $T_c$. $Co_{80-x}V_yB_{20}$ glasses with x>14 may show positive magnetostriction at 4.2 K (see FIG. 4). These Co-Mn-B and Co-Cr-B glasses are, therefore, non-magnetostrictive alloys. $Co_{74}Fe_6B_{20}$ and related glasses are non-magnetostrictive alloys that have approximately two times the magnetization of the permalloys for which $\lambda=0$. $Co_{71}Mn_9B_{20}$ glass is in the same category, with $\lambda=0$ and $\sigma$(295 K =111 emu/gm (4 $\pi$M=11 kGauss).

Figure 4:
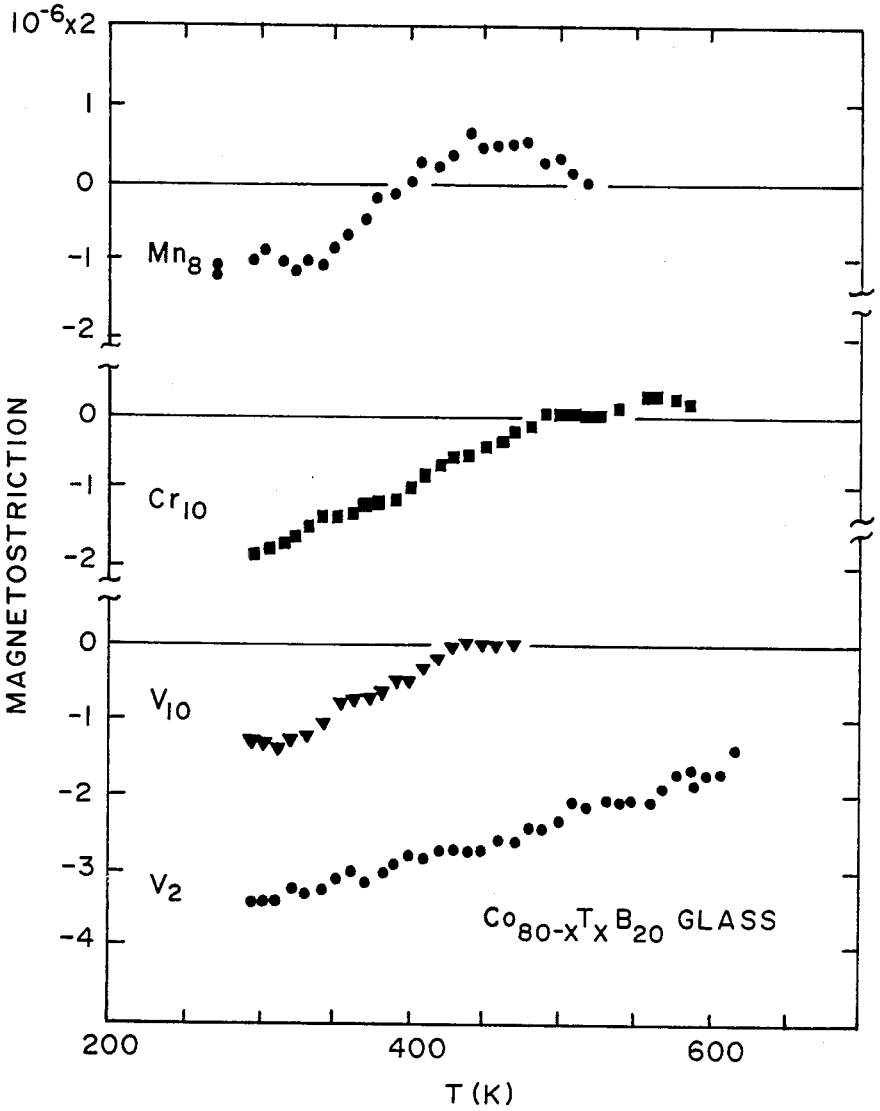
FIG. 4 is a graph showing the relationships between temperature and magnetostriction values for selected alloys of the invention.

The temperature dependence of $\lambda_s$ is shown in FIG. 4 for selected alloys. The sign of $\lambda_s$ was observed to change in two of the glasses. Such compensation temperatures have not previously been observed in metallic glasses. The vanadium containing glasses either become paramagnetic or they crystallize before any compensation can be realized. Thus, the negative magnetostriction glasses shown in FIG. 3 may be used in applications requiring $\lambda_s=0$ at some elevated temperature (up to approximately 200° C. above room temperature, which is not uncommon in many electronic devices).

The new low magnetostriction metallic glasses disclosed herein (Co-Cr-B and Co-V-B) show relatively low $4\pi M_s$ (FIG. 1). As a result, their utility is limited to applications requiring superior mechanical properties or improved corrosion resistance relative to permalloys or other $\lambda_s=0$ crystalline or non-crystalline materials.

Co-rich glass compositions with positive and negative magnetostriction can be added linearly to give zero magnetostriction. For example, $\lambda_s$ for Co and $Co_{80}B_{20}$ B glasses are +4 and $-4\times10^{-6}$, respectively. A 50—50 percent mixture of these glasses gives $Co_{75}Fe_5B_{20}$ which does in fact show $\lambda_s=0$ (O'Handley et al., IEEE Trans Mag-12, p. 942, 1976). Similarly, for $Co_{40}Ni_{40}B_{40}$ $\lambda_s=-7\times10^{-6}$ while for $Fe_{80}B_{20}$ $\lambda_s=32\times10^{-6}$. A linear mixture having $\lambda=0$ would be $0.18\times Fe_{80}B_{20})+0.82\times$(Cophd $40Ni_{40}B_{20})=Co_{33}Ni_{33}Fe_{14}B_{20}$ which is very close to the observed $\lambda_s$=composition $Co_{33.5}Ni_{33.5}Fe_{13}B_{20}$.

Figure 5:
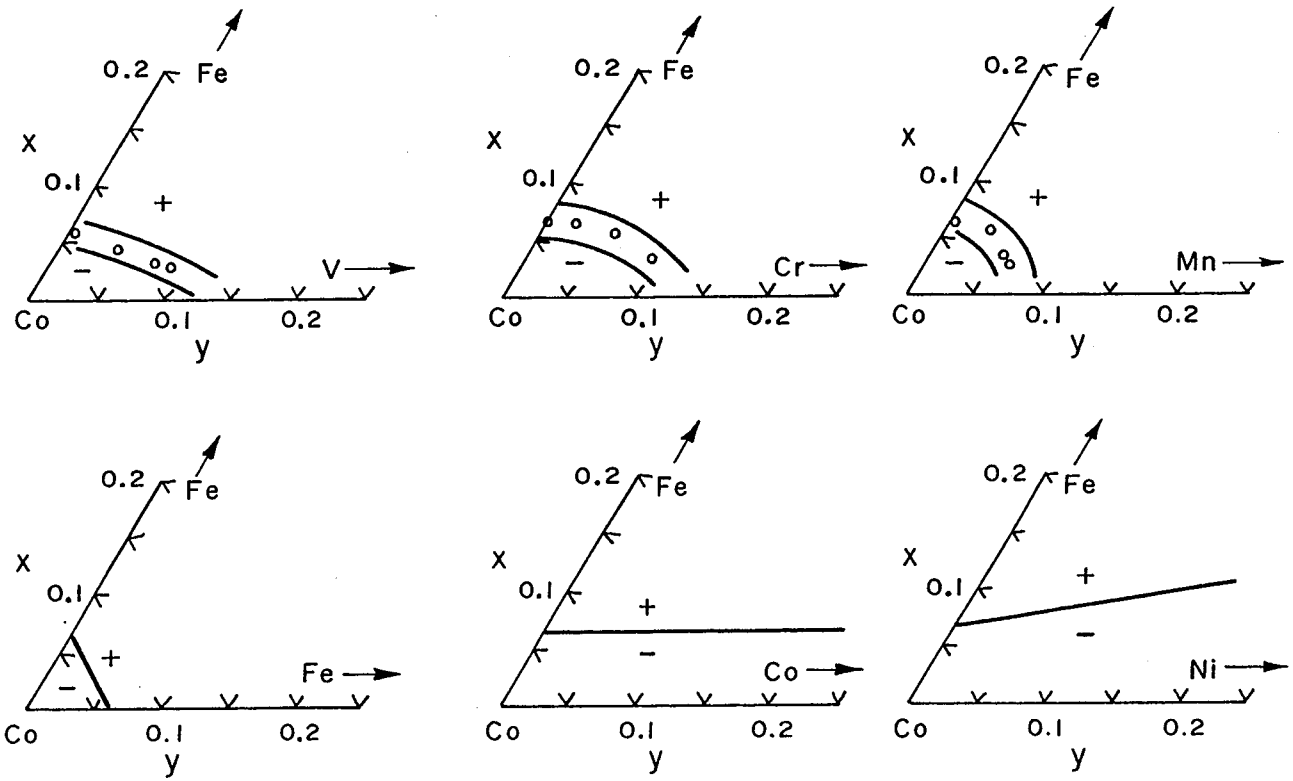
FIG. 5 shows the cobalt-rich corners of triangular diagrams for compositions defined by the formula $(Co_{1-x-y}Fe_xT_y)_{80}B_{20}$, where T is at least one of V, Cr, Mn, Fe, Co and Ni.

The rule of linear combination of opposing magnetostrictions (LCOM) has been applied to develop additional zero magnetostriction glasses from those measured and shown in FIG. 3. Table II lists several such glasses and FIG. 5 shows where they fall in the Co-rich corner of a triangular composition diagram. The lines connecting these newly developed $\lambda=0$ compositions closely follow the observations of Ohnuma and Masumoto (cited above) for (Co Fe X)$_{78}B_{14}Si_8$ glasses (with X=Mn, Cr, V) despite the different metalloids used in the two cases.

TABLE II

| Some Near-zero Magnetostriction Cobalt-rich Glasses Developed by the LCOM Method | |
|---|---|
| $Co_{73}Fe_{4.5}Mn_{2.5}B_{20}$ | $Co_{73}Fe_2Mn_5B_{20}$ |
| $Co_{73}Fe_{2.5}Mn_{4.5}B_{20}$ | |
| $Co_{73}Fe_5Cr_2B_{20}$ | $Co_{71}Fe_{4.5}Cr_{4.5}B_{20}$ |
| $Co_{70}Fe_{2.5}Cr_{7.5}B_{20}$ | |
| $Co_{73}Fe_{3.5}V_{3.5}B_{20}$ | $Co_{71}Fe_3V_6B_{20}$ |
| $Co_{70.5}Fe_{2.5}V_7B_{20}$ | $Co_{72.3}Fe_{4.3}V_{3.4}B_{20}$ |
| $Co_{70}Mn_5V_5B_{20}$ | $Co_{69}Mn_5Cr_6B_{20}$ |
| $Co_{66}Cr_8V_6B_{20}$ | |

The magnetostriction of Co-rich glasses is small because of the near-cancellation of two independent mechanisms for the magnetostriction, a positive two-ion interaction and a negative single-TM-ion term (O'Handley, Phys. Rev. B 18, p. 930, 1978). As a result, the TM makeup for $\lambda_s=0$ is nearly independent of TM/M ratio. That is, because $\lambda_s=0$ for ($Co_{0.94}Fe_{0.06}$, is nearly zero for other compositions $(Co_{0.94}Fe_{0.06})_{100-x}B_x$ such that 12<x<28 atom percent. An improvement on this approximation can be realized by taking into account the fact that the strength of the negative single-ion term varies linearly with the concentration of magnetic ions, i.e., at (100−x). The two-ion term should vary as the number of TM pairs at short range. However, observed trends in $Co_{100-x}B_x$ glasses (K. Narita, J. Yamasaki, and H. Fukunaga, Jour. Appl. Phys. Vol. 50, p. 7591, 1979 and J. Aboaf and E. Klokholm, ICM Munich Sept. 1979 to appear in Jour. Magnetism and Magnetic Materials), are best described by assuming the number of nearest neighbor TM pairs to be independent of x. This implies that the nearest-neighbor coordination of cobalt atoms by cobalt atoms does not vary strongly with x. Thus the compositional dependence of magnetostriction in Co-rich glasses is well described at room temperature by: $\lambda_s\alpha+6.8\times10^{-6}-10.2\times10^{-6}\times(100-x)/80$ where the first term is the observed two-ion component of magnetostriction (independent of composition x) and the second is the single-ion component of magnetostriction (which varies linearly with the TM concentration). Thus the magnetostriction becomes less negative as metalloid content increases, the change in $\lambda$ being $+0.13\times10^{-6}$ per atom percent more metalloid. Alternatively, the zero magnetostriction composition is shifted to glasses richer in iron as 100−x increases, the shift being approximately +0.23 percent Fe per 1 percent decrease in x.

As a result, the Co-Fe-T ratios (T=Mn, Cr, V) for $\lambda_s=0$ in FIG. 5 hold approximately for other TM/M ratios in the glass-forming range 12<x<28 atom percent. A first order correction shifts the $\lambda_s=0$ lines toward Fe by approximately 1 percent for every 4 percent decrease in x.

Metalloid type has little effect on the magnitude or sign of magnetostriction in Co-rich glasses (O'Handley in Amorphous Magnetism eds. R. Levy and R. Hasegawa, Plenum Press 1977, p. 379). Hence, the compositions in Table II and FIG. 5 will still be of near-zero magnetostriction if B is replaced by P, C, Si or some combination of these metaloids.

Figure 6:
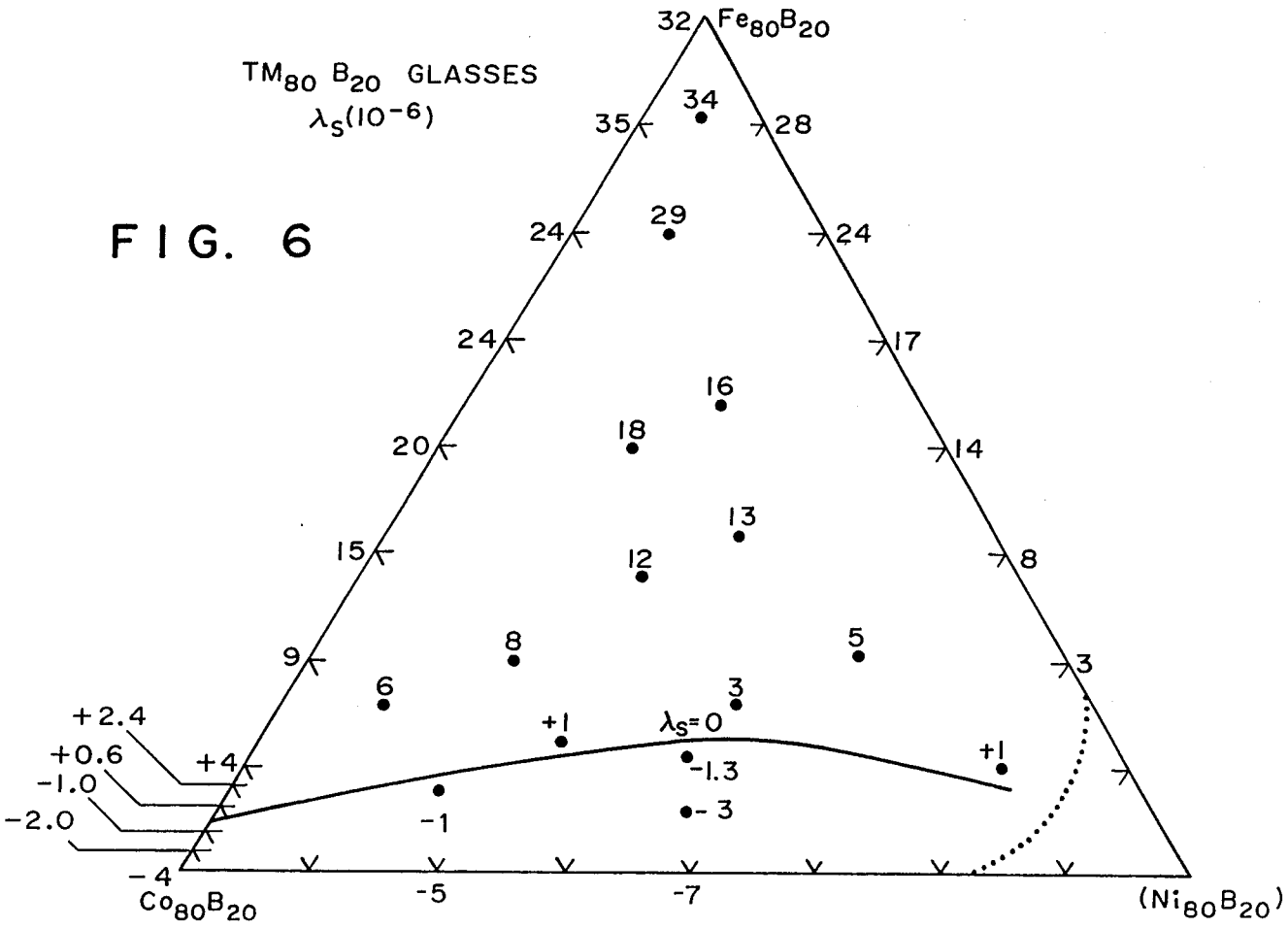
FIG. 6 is a triangular Fe-Co-Ni diagram showing regions of positive and negative magnetostriction, the dotted line isolating therefrom the region of nickel-rich compositions wherein amorphous metals are difficult to form and thermally unstable.

The rule of linear combination of opposing magnetostrictions (LCOM) can also be applied across the Co-Ni side of the Fe-Co-Ni triangular magnetostriction diagram shown in FIG. 6 (see also U.S. Pat. No. 4,150,981 to O'Handley). Table III sets forth some typical near-zero magnetostriction compositions.

TABLE III

New Co—Ni Base Glassy Alloys or Near-zero Magnetostriction Developed by LCOM Method.

| | |
|---|---|
| $Co_{66}Mn_9Ni_5B_{20}$ | $Co_{68.4}Mn_{8.3}Ni_{3.3}B_{20}$ |
| $Co_{53.7}Ni_{15.3}Fe_{5.5}Mn_{5.5}B_{20}$ | $Co_{52}Ni_{18}Fe_8Mn_2B_{20}$ |
| $Co_{41}Ni_{30}Fe_5Mn_4B_{20}$ | $Ni_{45}Co_{26.5}Fe_{7.5}Mn_1B_{20}$ |
| $Co_{58}Ni_{12}Fe_6Mn_4B_{20}$ | |
| $Co_{51}Ni_{18}Fe_8Cr_3B_{20}$ | $Co_{39}Ni_{30}Cr_6Fe_5B_{20}$ |
| $Co_{56}Ni_{12}Fe_6Cr_6B_{20}$ | $Co_{51}Ni_{18}Fe_9Cr_2B_{20}$ |
| $Co_{40}Ni_{30}Fe_5V_5B_{20}$ | $Co_{59}Ni_{12}Fe_6V_5B_{20}$ |

Referring to FIG. 6, a region of difficult to fabricate and relatively unstable glasses exists in the Ni-rich corner of the triangular Fe-Co-Ni diagram. Yet, glassy alloys of zero or low magnetostriction exist there with potential for various applications.

Ni-rich glasses are more easily made and are more stable if the "late" transition metal Ni is balanced to a certain extent by an "early" TM, e.g., Mn, Cr, V. Examples of such glasses include $Ni_{50}Mn_{30}B_{20}$, $Ni_{60}Cr_{20}B_{20}B_{20}$, or $Ni_{70}V_{10}B_{20}$.

Based on the evidence of $\lambda_s=0$ alloys set forth above and the known stabilizing effects of light TM's on Ni-rich glasses, new low magnetostriction glasses rich in Ni have been developed in the region below or near the $\lambda_s=0$ line in FIG. 8 (i.e., glasses initially showing $\lambda_s<0$) by the addition of Mn, Cr, and/or V. Thus, for example, $(Co_{0.25}Ni_{0.75})_{80}B_{20}$ can be rendered more fabricable and more stable in the glassy state, and its negative magnetostriction can be increased to near zero by substituting Mn, Cr or V for Co: $(Ni_{0.75}Co_{0.25-x}T_x)_{80}B_{20}$.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A magnetic alloy that is at least 50 percent glassy and consists essentially of a composition having the formula $(Co_{1-x-y-z}Fe_xNi_yT_z)_{100-b}(B_{1-w}M_w)_b$, where T is at least one of Mn, Cr, V, Ti, Mo, Nb and W, M is at least one of Si, P, C and Ge, B is boron, x ranges from about 0.05 to 0.25, Y ranges from about 0.05 to 0.80, z ranges from about 0 to 0.25, b ranges from about 12 to 30 atom percent, w ranges up to 0.75 when M is Si or Ge and up to 0.5 when M is C or P, said alloy having a value of magnetostriction of about $-7\times10^{-6}$ and $+5\times10^{-6}$ and a saturation induction of about 0.2 to 1.4 T.

2. A magnetic alloy, as recited in claim 1 wherein y ranges from about 0.3 to 0.6 and z is less than 0.2 when T is more than 50 percent of at least one of Cr and V, said alloy having a value of magnetostriction of about $-6\times10^{-6}$ to $+4\times10^{-6}$.

3. A magnetic alloy, as recited in claim 1 wherein y is at least 0.60 to 0.80 and z is less than 0.15 when T is more than 50 percent of at least one of Cr and V, said alloy having a value of magnetostriction of about $-6\times10^{-6}$ to $+4\times10^{-6}$.

* * * * *

UNITED STATES PATENT AND TRADEMARK OFFICE

CERTIFICATE OF CORRECTION

PATENT NO. : 4,755,239

DATED : July 5, 1988

INVENTOR(S) : R.C. O'Handley

It is certified that error appears in the above-identified patent and that said Letters Patent is hereby corrected as shown below:

Col. 1, line 33: "criteria" should read -- criteria. --.

line 52: "977" should read -- 1977 --.

line 62: "663" should read -- 5663 --.

Col. 2, line 22: "$_{B,}$" should read -- $_{b,}$ --.

line 35: "Mn, V, Ti, Mo, Nb" should read -- Mn, Cr, V, Ti, Mo, Nb --.

line 41: "and" should read -- to --.

Col. 4, line 30: "n" should read -- $n_B$ --.

line 31: "TC" should read -- $T_C$ --.

line 39: "$(Ni_{82}Fe_{18})$" should read -- $((Ni_{82}Fe_{18})$ --.

UNITED STATES PATENT AND TRADEMARK OFFICE

CERTIFICATE OF CORRECTION

PATENT NO. : 4,755,239

DATED : July 5, 1988

INVENTOR(S) : R.C. O'Handley

It is certified that error appears in the above-identified patent and that said Letters Patent are hereby corrected as shown below:

Col. 4, line 46: "$Co_{70}Fe_{10}B_{20}Co$" should read -- $Co_{70}Fe_{10}B_{20}$ --.

line 52: "hypothetic thetical" should read -- hypothetical --.

line 57: "Delete last "and".

line 58: "than 1 percent" should read -- is less than 1 percent --.

Col. 5, line 19: " $\lambda_5$" should read -- $\lambda_s$ --.

line 24: "$Co_{80-x}V_vB_{20}$" should read -- $Co_{80-x}V_xB_{20}$--.

UNITED STATES PATENT AND TRADEMARK OFFICE

CERTIFICATE OF CORRECTION

PATENT NO. : 4,755,239

DATED : July 5, 1988

INVENTOR(S) : R.C. O'Handley

It is certified that error appears in the above-identified patent and that said Letters Patent are hereby corrected as shown below:

Col. 5, line 59: "(Cophd 40 $Ni_{40}B_{20}$)" should read -- ($Co_{40}Ni_{40}B_{20}$) --.

line 68: "$\lambda = 0$" should read -- $\lambda_s = 0$ --.

Col. 6, line 23: "($Co_{0.94}Fe_{0.06}$," should read -- ($Co_{0.94}Fe_{0.06})_{80}B_{20}$, --.

Col. 8, line 20: "and" should read -- to --.

Signed and Sealed this

Eleventh Day of April, 1989

*Attest:*

DONALD J. QUIGG

*Attesting Officer*

*Commissioner of Patents and Trademarks*